US007896180B2

(12) United States Patent
Kenney

(10) Patent No.: US 7,896,180 B2
(45) Date of Patent: Mar. 1, 2011

(54) LIQUID CONTAINER WITH ADDITIVE DISPENSER

(76) Inventor: Michael Kenney, Milton, FL (US)

( * ) Notice: Subject to any disclaimer, the term of this patent is extended or adjusted under 35 U.S.C. 154(b) by 199 days.

(21) Appl. No.: 12/185,252

(22) Filed: Aug. 4, 2008

(65) Prior Publication Data

US 2010/0025350 A1 Feb. 4, 2010

(51) Int. Cl.
*F25D 3/08* (2006.01)

(52) U.S. Cl. ..... 215/6; 215/11.1; 215/12.1; 215/11.4; 215/11.5

(58) Field of Classification Search ..... 215/6, 365, 215/228, DIG. 8; 222/129; 220/601, 212; 206/47 A See application file for complete search history.

(56) References Cited

U.S. PATENT DOCUMENTS 2,786,769 A * 3/1957 Greenspan ..... 426/117
3,355,047 A * 11/1967 De Sole ..... 215/11.1
3,741,383 A * 6/1973 Wittwer ..... 206/219
5,244,122 A * 9/1993 Botts ..... 604/77
5,383,906 A * 1/1995 Burchett et al. ..... 606/236
5,419,445 A * 5/1995 Kaesemeyer ..... 215/11.1
5,467,877 A * 11/1995 Smith ..... 215/11.1
5,617,966 A * 4/1997 Bral ..... 215/11.4
5,824,012 A * 10/1998 Burchett et al. ..... 606/236
7,055,985 B2 6/2006 Patterson et al.

* cited by examiner

*Primary Examiner* — Anthony Stashick
*Assistant Examiner* — Cynthia F Collado
(74) *Attorney, Agent, or Firm* — Daniels Patent Law PLLC; Scott A. Daniels

(57) ABSTRACT

An improved drinking container for soft drinks, flavored drinks as well as other similar nutritional and energy supplement drink products which allow the end user to control the amount of flavor, mix, nutritional or energy supplement or any other additive added to the liquid drink product. The drinking container and method associated therewith permits an end user of the drinking container to controllably inject an additive into the liquid drink product to attain a desired ratio of additive in the drink product via a dispenser having measurement units marked or formed thereon to provide controlled amounts of the additive to the main liquid drink product such as water or carbonated water for flavoring, calorie control and/or nutritional supplements.

10 Claims, 4 Drawing Sheets

LIQUID CONTAINER WITH ADDITIVE DISPENSER

FIELD OF INVENTION

The present disclosure relates to an improved drinking container for soft drinks, flavored drinks as well as other similar nutritional and energy supplement drink products which allow the end user to control the amount of flavor, mix, nutritional or energy supplement or any other additive added to the liquid drink product. In particular, the present invention relates to a device and a method permitting an end user of the drinking container to controllably inject an additive into the liquid drink product to attain a desired ratio of additive in the drink product. The device includes a dispenser having measurement units marked or formed thereon to provide controlled amounts of the additive to the main liquid drink product such as water or carbonated water for flavoring, calorie control and/or nutritional supplements.

BACKGROUND OF THE DISCLOSURE

Protein powders, energy mixes, supplements, and other sport nutritional products, are frequently utilized in conjunction with regular exercise to promote a healthy lifestyle. Accordingly, consumers often purchase large containers or mixes, wherein many such powders or drink mixes must be combined with water or other suitable liquids to facilitate ingestion and digestion of same. However, despite the economical advantages and general long-term product supply afforded by such bulk purchases, the impracticalities and inconveniences associated with the use of such large containers of powders or mixes, in view of preferred consumer use, present noticeable disadvantages.

Specifically, many individuals utilize public gyms or fitness centers, wherein immediately following an exercise session, many such individuals prefer to ingest a favorite powdered sports drink for optimal bodily absorption. Accordingly, these individuals are often forced to inconveniently tote the large containers of powder to their fitness center for subsequent use, or pre-bag or pre-package smaller portions thereof prior to leaving home.

Additionally, because such powders must be combined with a liquid, consumers must undertake the time-consuming and often messy process of properly combining and mixing the powder with a glass or bottle of water. That is, when utilizing a glass, or other wide-mouthed container, of water, the consumer must measure and deposit the appropriate amount of sports powder within the glass and, thereafter, shake, stir or otherwise fully mix the combined dry and liquid contents. In doing so, powder and/or powder-liquid mix often spills from the wide mouth of the glass, resulting not only in mess and partial loss of product, but a potentially significant reduction in the manufacturer's recommended serving size. This latter disadvantage becomes particularly problematic when the consumer has painstakingly pre-measured and bagged or packed a limited amount of sports powder for use at his/her fitness center, leaving the much larger container of sports powder at his/her residence.

To avoid the spillage problems associated with mixing powdered sports drinks in wide-mouthed containers of water, many consumers will utilize a conventional personal-sized bottle of water, which typically have a relatively diametrically smaller mouth. In use, the bottle cap is threadably engaged to the bottle mouth following deposit of the sports powder therethrough; thus, enabling rapid and forcefully shaking and uniform mixture of the powder-water contents of the bottle, without risk of leakage or spillage of same. However, in utilizing such water bottles alone, consumers must attempt to feed or funnel the powder through the relatively narrow mouth of the bottle, which, more often than not, results in spillage of the sports powder.

As such, in an attempt to overcome the disadvantages associated with the foregoing system of powdered sports drink preparation, many available devices provide for a mixing cap engageable to a liquid container, wherein the mixing cap enables introduction of a dry or liquid ingredient into the communicating bottle for mixture with the liquid contents thereof.

The control of proper concentrations of mixtures in the field of food and beverage for proper tastes, nutrition and/or calorie counting is broad and a variety of mixture methods and container styles are used. In most cases the mixture is controlled in a pre-market form where the consumer receives a pre-dispensed concentration and has little or no control of the concentration at the point of consumption. In the beverage industry a large market of various flavors, calorie options, and nutritional values exists and the consumer is left to choose from this wide variety and through trial and error determine the most satisfactory concentrations and flavors for their own personal needs. The consumer in most instances has little or no control over the amount of sugar or calories, or the particular flavoring or concentration of flavoring that is added to their soda, sports drink or other beverage of their choice. The consumer is left to adapt to the taste of the pre-market product and/or accept the unwanted calories or non-nutritional ingredients.

Flavoring mixtures are pre-made and mixed with water or carbonated water and sports, soda or energy drink containers are filled with these mixtures and marketed to the consumer through a number of auspicious methodologies to sell the consumer on the unique formulas of one specific beverage compared to another, but fail to leave to the consumer control of concentrations within the purchased and consumed beverage. The control of calories or nutritious content is also not easily available to the consumer at the point of consumption where the consumer may want to add specific vitamins and or electrolytes, or reduce the concentration of sugary syrup flavorings. The consumer must very often settle by consuming a low or no calorie beverage, that does not provide the desired nutritional content. While the choices of off the shelf products that have a water or carbonated water base are numerous with a wide variety of flavorings and calorie options, it is still left to the consumer to pick from this variety to determine a suitable flavor, an acceptable calorie level, or a mix of satisfactory and beneficial nutrients to meet the needs of a particular consumer.

In the medical field there are various devices that control dosage levels of medications as prescribed and manipulated by a doctor or medical professional, but outside of the medical field, there are not simple mechanisms that can dispense a broad range of liquid mixtures in a water bottle or container and allow the consumer to easily manipulate the taste, or nutritional benefits of such over-the-counter soft drinks, energy drinks and sport drinks.

OBJECTS AND SUMMARY OF THE INVENTION

The present disclosure is directed towards a fluid mixture dispenser for use with water, carbonated water or other liquid drink products that controls mixture concentration, enhances flavor, provides nutritional benefits and/or reduces calories. This disclosure describes a controlled mix injector that may be integrated with a sports or energy drink bottle or other liquid container whereby the controlled mix injector can then disperse metered, or partially metered amounts of concentrated mixtures, vitamins or other nutrients, or flavorings. The controlled mix injector may allow the user or consumer to easily adjust the amount dispersed, to a suitable concentration based on taste preference, nutritional need or caloric intake.

In one embodiment, the controlled mix injector comprises a dispenser made of a plastic or a suitable material filled with syrup flavoring or other desired fluid mixture. The dispenser has a removable seal plunger at one end and an outlet with a pressure release valve. The dispenser is affixed to a sports or energy drink bottle with the removable seal plunger affixed to and accessible from the base of the bottle and the dispenser outlet within the bottle. The bottle further comprises a cap with an extended arm affixed to the cap whereby the extended arm extends into the bottle and meets the outlet end of the dispenser to seal the dispenser in any orientation of the bottle until removal of the cap. Upon removal of the cap with the extended arm, the extended arm may be inserted within the dispenser from the base of the bottle, thereby moving the plunger through the dispenser causing the fluid mixture within the dispenser to be expelled into the water, carbonated water or other liquid within the sports or energy drink bottle. Alternatively the dispenser may be integrated with another type of liquid container other than a bottle, such as a sealable plastic bag and the dispenser may allow movement of the plunger manually with the use of a finger or another extendable fixture to disperse the fluid mixture into the water, carbonated beverage, or other liquid without removing the cap or opening the container.

The dispenser may alternatively comprise an external cone that is integrated within a bottle. The external cone would be filled with fluid by inserting a removable fluid filled cartridge having an internal plunger and outlet with pressure relief valve or other sealing mechanism. The cartridges are filled externally with fluid mixtures that may contain flavorings, nutrients, vitamins, electrolytes, and/or specific caloric levels and ingredients. Upon actuation of the plunger the internal plunger of the cartridge is collapsed into the cartridge and the fluid mixture is expelled through the external cone and dispersed into the water, carbonated water or other liquid within the bottle or container.

The amount or concentration of fluid mixture may be controlled by restricting the movement of the plunger to a level less than the complete length of the dispenser. The dispenser of the mix injector may provide a scale indicator with marked settings that specify mixture concentrations. The marked indicators may alternatively indicate calories per ounce or per milliliter, or a preset dosage level, or a specific ingredient content, such as the amount of sugar dispensed from syrup flavoring for a carbonated soda or beverage. Further alternatives are to have the scale indicator labeled with specific concentrations that indicate the amount of vitamins or electrolytes or other nutrients that will be dispensed with each successive movement of the plunger. The scale indicator may also show a specific reference for each change in flavor as an increase in amount of fluid mixture is made, the references may have dedicated names or significance. Each adjustment of the plunger or other actuator increases the concentration of fluid mixture in the liquid to allow the user or consumer to adjust the flavor or ingredients in the mixture providing control of taste or nutritional value.

An objective of the invention is to provide control to the concentration of fluid mixtures, and allow this concentration to be easily set at the time of consumption.

Another objective of the invention is to provide a self contained mix injector that when integrated with a bottle or other liquid container comprises the components of a fluid mixture dispenser, a plunger seal and extension arm to actuate the plunger and dispense the fluid mixture within the container.

Another objective of the invention is to provide a mix injector operatively sealed by the cap of a bottle, the cap having an extension arm that may be used to actuate a plunger within the mix injector to disperse the fluid mixture into the liquid of the bottle.

A further objective of the invention is to provide a mix injector with removable cartridge that may be filled with a variety of fluid mixtures and be offered separately to the mix injector integrated with a liquid container, thus allowing the liquid containers to be cleaned and reused, with other removable cartridges.

A yet still further object of the invention is to manufacture, ship and sell the bottle(s) with only the fluid mixture in the mix injector and without the main liquid in the bottle to reduce fuel and shipping costs thereby providing the consumer with the opportunity to add their own desired main liquid, such as water, soda water, juice etc., on their own accord.

The embodiments of this invention provide effective alternatives to consumers for choice of ingredient and mixture concentration of beverages. The controlled mix injector can be integrated with a variety of liquid containers, and provides a self-contained mechanism to adjust the concentration with scale indicators and markings to reproducibly provide accurate tastes, ingredient content, and caloric levels to suit the consumer's own personal needs. The design with removable fluid filled cartridge allows the reuse of bottles and containers and reduces the consumption of material for the production of liquid containers used for beverages that are mixed using water, carbonated water or other liquids. The above and other objectives and advantages and novel features of this invention will be more fully understood from the following detailed description and the accompanying drawings.

The invention includes a mix injector comprising a dispenser filled with an additive having an operatively sealed outlet, the dispenser integrated within a liquid container, a plunger inserted within the dispenser, and wherein upon actuation of the plunger, the additive in the dispenser is collapsed releasing the operatively sealed outlet and dispersing the additive into the liquid container.

The invention further describes a method for dispersing additives into liquid containers comprising filling a mix injector with an additive, inserting the mix injector within a liquid container, actuating the mix injector, and wherein actuation of the mix injector disperses the additive into the liquid container.

DETAILED DESCRIPTION OF THE DRAWINGS

DETAILED DESCRIPTION OF THE INVENTION

Figure 1:
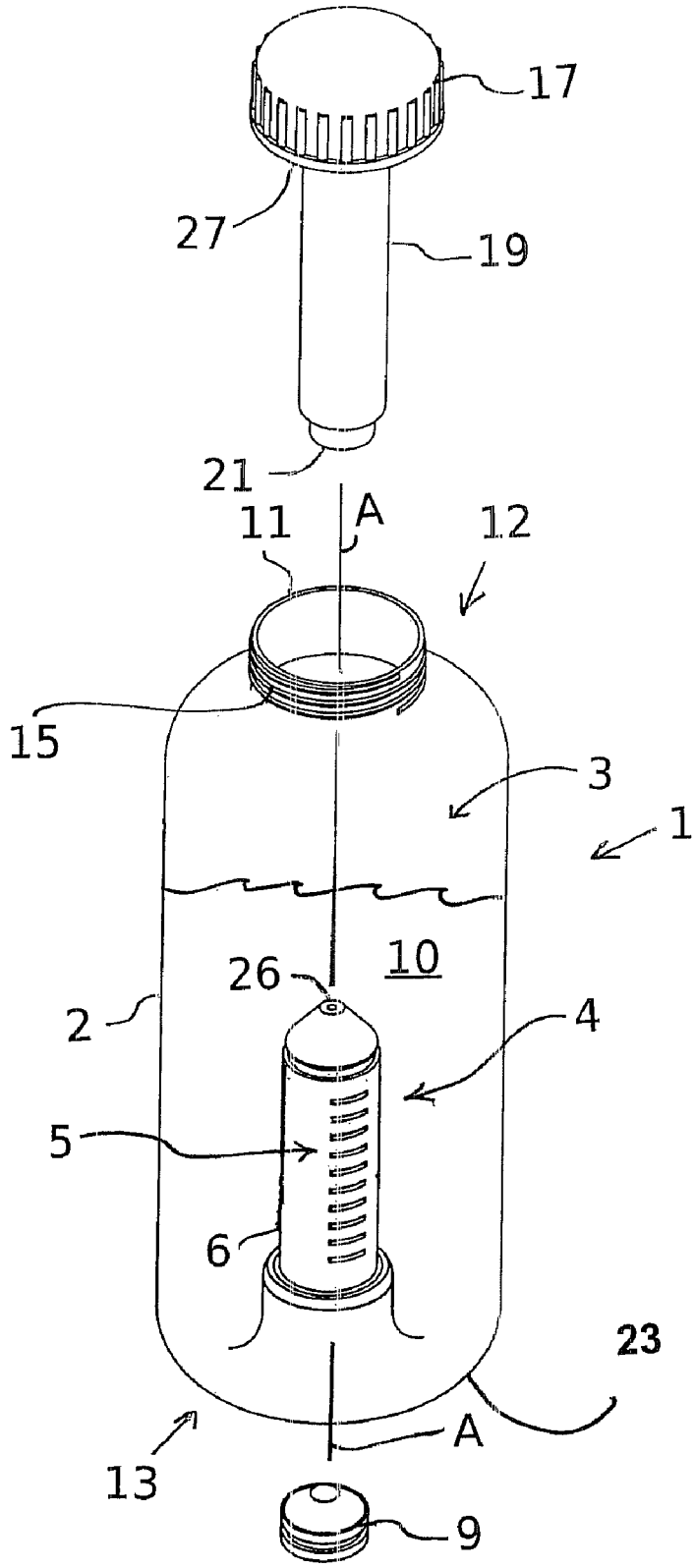
FIG. 1 is a perspective view of the first embodiment of the present invention of the dispensing device in conjunction with a bottle 1.

In describing the preferred and alternate embodiments of the present invention, as illustrated in FIGS. 1-4, specific terminology is employed for the sake of clarity. The invention, however, is not intended to be limited to this specific terminology so selected, and it is to be understood that each specific element includes all technical equivalents that operate in a similar manner to accomplish similar functions.

Referring now to FIGS. 1-4, the present invention, in a preferred embodiment, is a bottle 1 being a two-part system defined by two communicating cavities formed to contain a main liquid product 10 in a product reservoir 3 fixed in shape and volume, and to have an additive dispenser 4 and a method for use thereof wherein the dispenser 4 comprises an additive reservoir 5 defining a predetermined, but variable volume containing an additive to be selectively added to the main product 10. The predetermined volume of the additive reservoir 5 which is generally fixed in shape and variable in volume is discussed in detail below, and is sufficiently large that a user can observe and measure at least a desired partial amount of an additive in the dispenser 4 reservoir being dispensed into the main product 10 in the bottle 1.

The bottle 1 which can be of a blow-molded type fabricated from polyethylene terephthalate (PET) or other such similar compounds and manufacturing processes used to fabricate plastic drinking bottles, comprises a main wall 2 defining the product reservoir 3 in which the main liquid product 10 to be consumed by the user is contained. The main wall 2 is contiguously formed with an inner wall 6 which forms the dispenser 4 and additive reservoir 5. The inner wall 6 is formed so as to accept a moveable plunger for forcing the additive out of the inner reservoir and into the main reservoir to mix the additive with a liquid in the main reservoir as will be discussed in further detail below.

The bottle 1 and dispenser 4 formed from a suitable plastic substrate such as polyethylene terephalate (PET) has sufficient structural rigidity to prevent deformation, breakage and/or tearing of the same during implementation of the described method. Accordingly, the bottle 1 including the outer and inner wall 6 are preferably formed via a blow molding processes, injection molding processes, or the like. Additionally, during manufacture, the additive reservoir 5 may be preloaded with a selected dry or liquid additive ingredient to facilitate subsequent consumer use. Also, as more fully described below, it is further contemplated that the dispenser 4 may be loaded with a selected ingredient at a time of initial consumer use (i.e. post-manufacture). It should be recognized that other suitable materials or substrates may be utilized to form the dispenser 4 such as for exemplary purposes only metals, metal alloys, ceramic, carbon fiber or the like.

Referring now specifically to the embodiment shown in FIG. 1, the bottle 1 is defined by the main wall 2 having a conventional cylindrical elongate bottle shape with a top end 12 and a bottom end 13. The main wall 2 extends along a main axis A from an upper end 11 having an opening, to a bottom end 13 defining a base 23 of the bottle 1. While such bottles are generally cylindrical in nature it is to be understood that the main wall 2 could also be provided with any series of indentations or contours, such as an hourglass or similarly shaped contour, and decorations or topographical features such as ribs or textured surface areas may also be provided to facilitate gripping the bottle 1.

The upper end 11 and the opening therein will generally comprise a threaded opening 15 from which the user drinks the bottled product 10 from the product reservoir 3 or pours the product 10 into a glass or other receiving container. As is known in the art the threaded opening 15 is closed by a cap 17 which has an inner threaded surface to matingly engage with the threaded opening 15. In the present embodiment shown in FIG. 1, the cap 17 is provided with a plunger column 19 affixed to an inner surface 27 of the cap 17 and depending axially downward from the inner surface 27 of the cap 17 along the main axis A of the bottle 1. The plunger column 19 has a free end 21 which depends downwardly from the cap 17 to such a length that when the cap 17 is screwed down over the threaded opening 15 the free end 21 is intended to engage with and cover an outlet of the dispenser 4 as discussed in further detail below.

Figure 2:
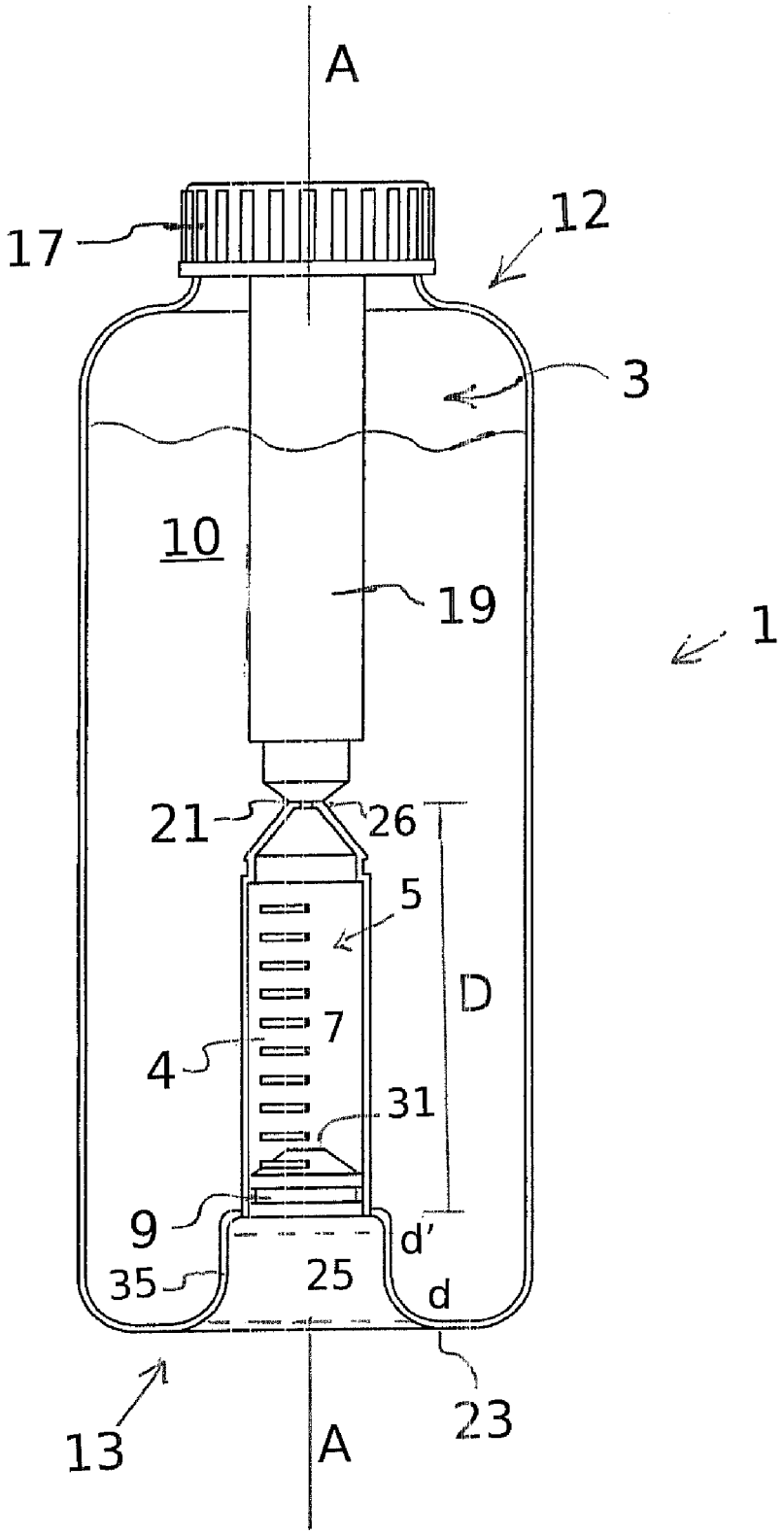
FIG. 2 is a side elevation view of the dispensing device in the bottle 1 in a closed non-dispensing state.

From the upper end 11 the main wall 2 extends downwardly to the bottom end 13 of the bottle 1 which defines the base 23 upon which the bottle 1 is generally intended to rest on a supporting surface. In the center of the base 23, a cavity 25 is formed whereby the material forming the bottle 1, main wall 2 and base 23 is inverted in a substantially circular cross-section extending along the axis of the bottle 1 so as to define the dispenser 4. The dispenser 4 in the embodiment of FIG. 2 is shown having a cross-section and length extending a desired distance D into the bottle 1 so as to define a sufficient volume for the additive reservoir 5 into which the additive 7 is placed or stored either during manufacturing or afterwards.

An end of the additive reservoir 5 which extends into an intermediate portion of the product reservoir 3 is formed having an outlet 26 from which the additive 7 is dispensed into the product 10 in the product reservoir 3. This outlet 26 may be merely a hole, i.e. an open hole, or the outlet 26 may include a valve, a cover or a gasket to inhibit the free passage of the additive 7 between the product reservoir 3 and the additive reservoir 5 and vice versa if necessary. The idea in any event, is to maintain any additive 7 within the additive reservoir 5 so that it does not mix with the liquid until desired by the user and forced out of the additive reservoir 5.

The additive reservoir 5 as it is defined by the cavity 25 has an inner surface 27 and an outer surface 29. The inner surface 27 is the inner most surface against which any additive 7 inside the cavity 25 or in the additive reservoir 5 is maintained and which directly supports the plunger 9 as discussed below. The outer surface 29 of the additive reservoir 5 is in direct contact with the liquid in the main product reservoir 3 and either the outer or inner surfaces may have visible graduated unit marks or indicia 30 formed thereon to inform the user as to the volume of the additive 7 in the additive reservoir 5. The inner and outer surfaces of the additive reservoir 5 may generally be formed contiguous with the material making up the base 23 and the main wall 2 of the bottle 1. In the blow-molding or injection molding process, it may be most efficient to form the main wall 2 as well as the cavity 25 and additive reservoir 5 together and contiguous. It may also be efficient in some manufacturing process to manufacture the additive reservoir 5 and the main wall 2 of the bottle 1 in separate processes and then affix or attach them in some way, but for purposes of the present embodiment we will consider that these elements are formed together and contiguous.

As discussed, the outer surface 29 of the additive reservoir 5 is provided with a series of graduated unit marks 30 which may, for instance, display a specific volume or mass of additive 7 to the user, such as by ounce or half-ounce increments so that when the additive 7 is dispensed by the user, the user can tell how much of the additive 7 has been dispensed and/or is remaining within the inner reservoir. Alternatively, where the bottle is not transparent or for other reasons, the plunger column 19 may be provided with visible incremental unit measurement indicia so that the user can see how much additive 7 has been dispensed.

Observing FIG. 2, we see that in a closed state of the bottle 1, the threaded cap 17 is provided secured over the opening of the bottle 1 and the plunger column 19 extends downwardly along the axis A so that the free end 21 of the plunger column 19 abuts the outlet 26 of the additive reservoir 5. The free end 21 of the plunger column 19 in this closed state thus may also cover the outlet 26, and where no other valve or cover is provided in conjunction with the outlet 26 ensures that there is no leakage of the additive 7 into the product in the product reservoir 3. Also, this ensures that there is no inadvertent discharge of the additive 7 where the outlet 26 is sealed prior to purchase of the product and the plunger column 19 is initially separate from the plunger 9. A tip portion of the plunger column 19 may be fabricated in such a manner so as to provide a seal, for example the tip portion may include a rubber gasket or some such similar material to facilitate sealing the outlet 26 in the closed state. Also the tip portion is formed in such a manner as to readily engage with a plunger 9 in the dispenser 4 for dispensing the additive 7 as discussed below.

Figure 3:
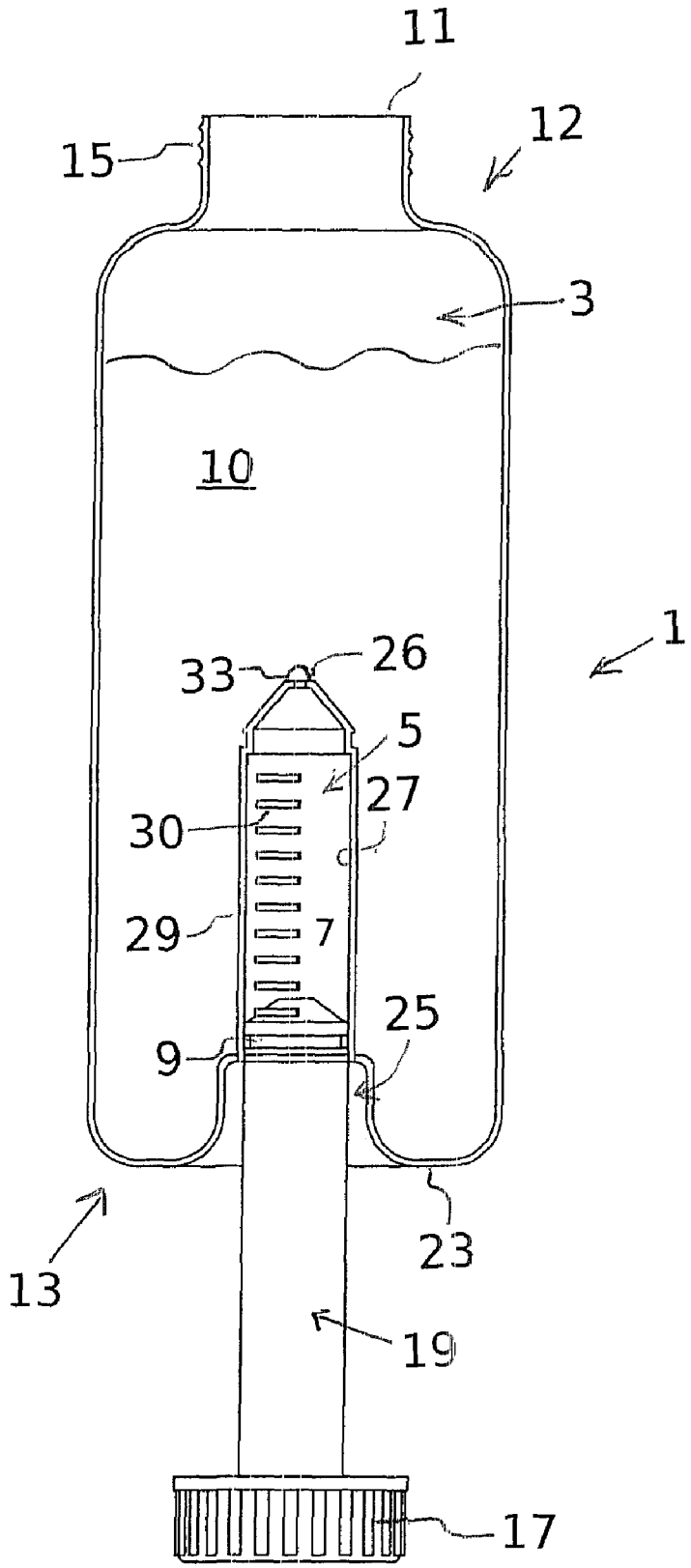
FIG. 3 is a side elevation view of the dispensing device in the bottle 1 in an open dispensing state.

As also seen in FIG. 2, the plunger 9 is provided inserted in the inner reservoir at a lower most portion thereof, i.e. closer to the base 23 of the bottle 1 than the outlet 26 of the dispenser 4 so that the additive 7 is substantially contained in the additive reservoir 5 between the outlet 26 and a nose 31 of the plunger 9. When it is desired for a certain amount of the additive 7 to be added to the liquid in the main reservoir, the cap 17 is removed from the threaded opening 15 and, as seen in FIG. 3, the free end 21 of the plunger column 19, in particular the tip, is inserted into a receiving portion of the plunger 9. The receiving portion of the plunger 9 can be formed so as to be a female or male mating key configuration with the tip of the plunger column 19 having an oppositely formed mating key formed thereon. With the outlet 26 of the dispenser 4 now open, or unimpeded by the tip of the plunger column 19, and the plunger column 19 now influencing the plunger 9, a user may push upwards on the cap 17 and plunger column 19 and thus force the plunger column 19 and hence the plunger 9 upwards into the additive reservoir 5 thereby forcing the additive 7 out of the outlet 26 and into the main reservoir of the bottle 1 to mix with the main product therein.

It is to be appreciated that the outlet 26 may also be a valve or a flexible flap to retain additive 7 within the additive reservoir 5 and may not necessarily need to be blocked or stopped by the extending plunger column 19. Alternatively, the outlet 26 may not need a valve, but may be sized so as to facilitate the retention of the additive 7 and the main product by capillary action and/or based on different specific gravities of the additive 7 and main product.

Figure 4:
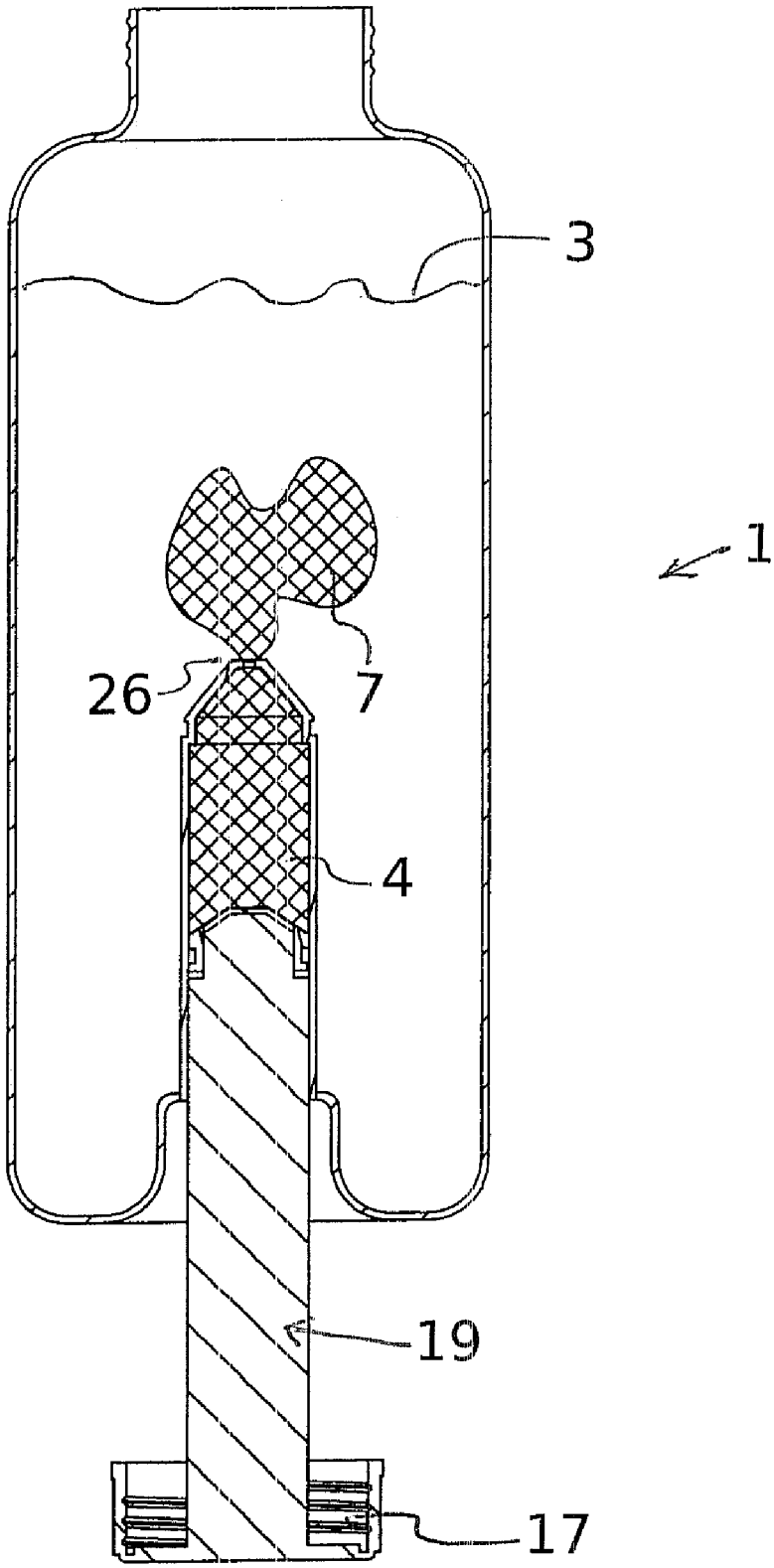
FIG. 4 is a side elevation view of the dispensing device in the bottle 1 in an open dispensing state and the additive partially injected into the bottle 1.

FIG. 4 shows in cross-hatch that a certain volume or mass of the additive 7 has been dispensed through the outlet 26 of the dispenser 4 and into the main product reservoir 3 where it may then mix with the fluid contained within the bottle 1. The outlet 26 may also be provided with a pressure relief valve 33 such that when the user no longer presses on the cap 17 and the plunger column 19 the plunger 9 remains in a desired axial position within the dispenser 4 and does not create any over pressures inside the reservoir to eject the additive 7. The ratio of additive 7 that is mixed with the main product is of course variable. However in general the ratio of volume of the product reservoir 3 to the volume of the dispenser 4 is approximately in the range of 2:1 to 10:1, and more preferably in the range of 4:1 to 8:1

The entrance to the cavity 25 which defines the dispenser 4 and additive reservoir 5 may be partially formed having a funnel portion 35 including a larger diameter d at the base 23 and narrowing substantially consistently to a smaller inner diameter d'. Such a funnel shaped entrance facilitates the alignment of the plunger column 19 with the plunger 9 in the dispenser 4 and the connection of the plunger column 19 and plunger 9 when it is desired to dispense and mix a certain amount of the additive 7 with the main product. A guide, or lip, may also be provided on the funnel portion 35 at the entrance to the cavity 25 defining the additive reservoir 5 to ensure that the plunger column 19 remains substantially axially aligned along the main axis A. The guide or lip is also positioned axially below the plunger so as to ensure that in the post-manufacture state and pre-sale state the plunger 9 does not fall out of the dispenser 4. Additionally, the plunger 9 may be provided with an indicator in regards to its positioning relative to this guide or lip indicating whether the plunger 9 has been tampered with or adjusted prior to sale.

Once the desired amount of additive 7 is dispensed into the product reservoir 3, the plunger column 19 and cap 17 may be removed from the plunger 9 and the plunger 9 remains in the axial position within the additive reservoir 5 it was urged to by the plunger column 19. The plunger 9 is maintained in the desired axial position via friction of the side of the plunger 9 in contact with the inner surface 27 of the additive reservoir 5. The user may then place the cap 17 and plunger column 19 back onto the opening at the upper end 11 of the bottle 1 securing the cap 17 and then for example shaking the container to mix the additive 7 into the fluid in the main product reservoir 3. When the cap 17 is next removed, the product is ready to drink with the desired amount of additive 7 added and mixed in.

It is to be appreciated that the plunger column 19 and the cap 17 may be separate or break-away items. The user may not desire to use the column 19 or may want to dispose of the column 19 and use their finger to actuate the plunger 9 so that the plunger column 19 may be removed from its connection with the cap 17 and the plunger column 19 disposed of. In this case the cap 17 may be retained and the bottle 1 may even have a threaded portion formed in the base 23 of the bottle 1 matching the threaded opening 15 to permit the user to screw the cap 17 thereto for storage or so as not to lose the cap 17 while drinking the product.

In a further embodiment of the invention, the cap 17 may not necessarily be provided with the plunger column 19. Where a valve or pressure relief valve 33, as previously discussed, is used to cover the outlet 26 a user may actually use their finger to push the plunger 9 a desired distance up and into the additive reservoir 5 and so force additive 7 through the outlet 26 and the valve therein and into the main product reservoir 3. It is to be appreciated that the bottle itself could be of a recyclable material so that the bottle 1 may be easily disposed of and/or recycled, or the product may be made out of a more resilient harder material so as to be reused if desired.

In a still further embodiment of the invention, a capsule may be provided for insertion into the cavity 25 defining the additive reservoir 5 so that a user may add any number of different additives and dispense them via the above described manner. The capsule may even be the plunger column 19 which can be hollow and filled with a desired additive 7. The plunger column 19 may also be a break-away capsule containing the desired additive 7 to be mixed with the product in the product reservoir 3.

Although the present invention contemplates use of the additive reservoir 5 for powdered sports drinks, supplements and the like, it should be recognized that the dispenser 4, or any dimensional variation thereof, may be utilized to facilitate the introduction and mixture of any selected ingredient, additive 7 or the like to the contents of the bottle 1 or container. As such, the present invention may be utilized to mix concentrated beverage powders with water, example, GATORADE®, gels with suitable liquids, salad dressings, baby formulas, medicines, chemicals, oils or the like.

In a still further embodiment of the present invention the plunger column 19 as it is connected to the cap 17 may be formed as the dispenser 4 with a volume defined therein and an additive 7 contained initially in this volume of the plunger column 19. A top mounted plunger 9 formed or attached in conjunction with this plunger column 19 may be combined with the cap 17 and plunger column 19 through the threaded opening 15 in the upper end 11 of the bottle 1. This dispenser 4 which is thus formed in conjunction with the cap 17, and not the bottle 1 or main wall 2 of the bottle 1 makes the bottle 1 easier to manufacture.

Having thus described the exemplary embodiments of the present invention it should be noted by those skilled in the art that the noted disclosures are exemplary only, and that various other alternative, adaptations and modifications may be made within the scope of the present invention. For example the bottle 1 may have a structure, integrity and rigidity that lends itself to being either or both of a disposable and non-disposable bottle either of which may allow the user to clean and/or reuse the bottle 1. Accordingly, the present invention is not limited to the specific embodiments herein, but is limited only by the following claims.

What is claimed is:

1. A mix injector comprising:

a bottle having a main product reservoir and a dispenser defining a second reservoir having an outlet communicating with the main product reservoir, the dispenser being an integrated component within the bottle;

a plunger for insertion within the dispenser; and wherein upon insertion of the plunger into the dispenser, an additive in the dispenser is advanced through the outlet and dispersed into the main product reservoir of the bottle to create a mixture constituting the additive and a main liquid in the main product reservoir; and wherein in a closed state the bottle has a main opening sealed with a cap having a plunger column having a length capable of reaching the outlet of the second reservoir and sealing the outlet.

2. The mix injector of claim 1 wherein in an open state the cap having the plunger column may be removed from the main opening of the bottle and the plunger column is engaged with the plunger in the dispenser to actuate the dispenser and advance the additive into the main product reservoir.

3. The mix injector of claim 1 wherein the dispenser further comprises a funnel for receiving and aligning the plunger and the plunger column.

4. The mix injector of claim 3 wherein an additive filled capsule is inserted into the dispenser prior to the plunger and the plunger column.

5. The mix injector of claim 1 wherein the outlet of the dispenser includes a valve facilitating maintaining the additive in the dispenser.

6. The mix injector if claim 4 wherein the mix injector is reusable by replacing the additive filled capsule.

7. The mix injector of claim 1 wherein the dispenser further comprises volumetric measuring indicia.

8. A controlled mix injector for a bottle comprising:

a dispenser;

an additive within the dispenser;

a manual actuator capable of metering the dispersion of an additive from the dispenser into a main reservoir of the bottle; and a passage formed in the dispenser wherein upon actuation of the manual actuator a metered amount of additive from the dispenser is dispersed into the main reservoir;

the manual actuator further comprises a moveable plunger positioned within the dispenser for applying pressure to the additive and so forcing the additive through the passage and into the main reservoir;

a plunger column separate from the plunger and engageable with the plunger to force additive from the dispenser into the main reservoir; and a removable cap for sealing a main opening of the bottle into main reservoir wherein the plunger column is connected to the cap.

9. The controlled mix injector for the bottle as set forth in claim 8 wherein in a first state the plunger column substantially seals the passage between the dispenser and the main reservoir and a second state wherein the plunger column is engaged with the plunger to facilitate movement of additive from the dispenser to the main reservoir.

10. A method for dispersing an additive into liquid containers comprising the steps of:

forming a bottle having a main product reservoir and a dispenser defining a second reservoir and forming an outlet communicating between the dispenser and the main product reservoir, the dispenser being an integrated component within the bottle;

providing a plunger for insertion within the dispenser; and inserting the plunger into the dispenser and advancing an additive in the dispenser is advanced through the outlet and dispersed into the main product reservoir of the bottle to create a mixture constituting the additive and a main liquid in the main product reservoir; and sealing a main opening of the bottle in a closed state with a cap having a plunger column having a length capable of reaching the outlet of the second reservoir and sealing the outlet.

* * * * *